US005659836A

United States Patent [19]

Hyakutake et al.

[11] Patent Number: 5,659,836

[45] Date of Patent: Aug. 19, 1997

[54] TRANSFER DRUM HAVING A LOW-REFLECTIVITY AREA

[75] Inventors: Nobuo Hyakutake; Fumio Furusawa; Takashi Kawabata; Masaaki Tokunaga, all of Ebina, Japan

[73] Assignee: Fuji Xerox Co., Ltd.

[21] Appl. No.: 573,006

[22] Filed: Dec. 15, 1995

[30] Foreign Application Priority Data

Dec. 19, 1994 [JP] Japan ..... 6-315301

[51] Int. Cl.[6] ..... G03G 15/00; G03G 15/01

[52] U.S. Cl. ..... 399/16; 399/31; 399/303

[58] Field of Search ..... 355/203, 206, 355/208, 271, 274, 316, 317; 399/16, 31, 303

[56] References Cited

U.S. PATENT DOCUMENTS 5,339,136 8/1994 Parsons et al. ..... 355/208

FOREIGN PATENT DOCUMENTS 3-266674 11/1991 Japan .

*Primary Examiner*—Dan H. Pendegrass

*Attorney, Agent, or Firm*—Oliff & Berridge

[57] ABSTRACT

A predetermined sheet retaining plane C for absorbing a record sheet is provided in the circumferential surface of a sheet carrier, and a low-reflectivity area which is to be partially covered with the record sheet is provided at a leading portion of the sheet retaining plane C. Reflection photosensors for detecting the reflectivity of the sheet carrier including the low-reflectivity area are disposed around the sheet carrier. Whether a record sheet is held in the sheet retaining plane C is judged on the basis of detection signals of the photosensors.

10 Claims, 7 Drawing Sheets

TRANSFER DRUM HAVING A LOW-REFLECTIVITY AREA

BACKGROUND OF THE INVENTION

1. Field of the Invention

This invention relates to an image forming apparatus which forms an image by transferring a toner image that is formed on an image carrier such as a photosensitive drum to a record sheet held by a sheet carrier.

2. Description of the Related Art

There is a system in which a sheet carrier, around which a dielectric film is wrapped, holds a record sheet and a toner image is transferred to the record sheet by synchronously rotating the sheet carrier and an image carrier. This system has been known as one system for transferring the toner image formed on an image carrier, such as a photoreceptor drum, to a record sheet. In this system, the record sheet electrostatically holds the dielectric film by affording electrical charges to the dielectric film, which advantageously results in the conveyance of the record sheet and the separation of a latent image carrier from the record sheet in association with the transfer of the toner image.

For these reasons, this system is suitable for a color copier which is required to effect multiple transfer of toner images in a plurality of colors to the record sheet. In a conventional color copier, the sheet carrier holding the record sheet in an absorptive manner is repeatedly rotated in synchronism with the image carrier, so that color toner images, i.e., black, yellow, cyan, and magenta images formed in this order on the image carrier, are repeatedly transferred to the record sheet.

In the image forming apparatus that transfers a toner image in this way, sheet detection sensors are usually disposed at several points in the sheet carrier so as to be able to detect the record sheet held by the sheet carrier, as required. These sensors are provided in order to detect whether the record sheet is held at a predetermined location on the sheet carrier at predetermined timing or has become separated from that location. An error in absorption or separation of the record sheet is judged based on a detection signal from the sheet detection sensor. If such sheet conveyance error arises, an image forming operation will be immediately stopped.

A reflection photosensor made up of a light emitting portion and a light receiving portion in combination has conventionally been used for the sheet detection sensor. The photosensor is arranged in such a way as to judge whether or not the record sheet has passed an imaginary line connecting between the light emitting portion and the light receiving portion of the sheet detection sensor on the basis of a difference in the amount of light reflected from the sheet carrier itself and the amount of light reflected from the record sheet. FIG. 8 shows a detection signal of the sheet detection sensor which varies corresponding to the amount of reflected light received by the sensor. This plot shows that the detection signal output becomes larger as the amount of reflected light becomes smaller. The record sheet is specifically detected by checking whether or not the detection signal output is larger than a predetermined threshold value. When the white plain leading end of the record sheet has passed the imaginary line between the light receiving portion and the light emitting portion of the sheet detection sensor, the detection signal output varies so as to cross the threshold value, so that the record sheet is detected.

However, in the conventional image forming apparatus which detects the record sheet on the sheet carrier in the manner as previously mentioned, if the area ratio of a toner image transferred to the record sheet was considerably large, and if a margin between the leading end of the record sheet and the image was extremely small, it was impossible to accurately detect whether or not the leading end of the record sheet had passed the imaginary line between the light receiving portion and the light emitting portion of the sheet detection sensor. This was because a smaller amount of light reflected from the leading end of the record sheet led to a smaller difference between the amount of light reflected from the leading end of the sheet and the amount of light reflected from the sheet carrier, as shown in FIG. 9. Particularly in the case of a color copier, solid images such as photographs and pictures are frequently copied. If a margin between the leading end of the record sheet and the image is set smaller in order to enhance the appearance of a copied image, it becomes impossible to detect the record sheet the instant when several color toner images have been transferred.

Further, when an OHP film is used as the record sheet, the light emitted from the photosensor is reflected from the sheet carrier after having passed through the OHP film, which makes it impossible to detect the record sheet based on the detection signal from the photosensor. For this reason, an OHP film having its leading end painted in white has conventionally been used in the image forming apparatus with the aforementioned construction. However, since the area that was made opaque in white was small, it was difficult for the conventional image forming apparatus to accurately judge whether or not the sheet carrier absorbs the OHP film.

On the other hand, in the previously mentioned image forming apparatus in which the sheet carrier electrostatically absorbs the record sheet, it is necessary to remove residual electrical charges on the sheet carrier every time one cycle of the image forming operation has finished, in order to prevent the sheet carrier from erroneously absorbing the record sheet or to prevent a toner image from being erroneously transferred to the record sheet. To eliminate the residual electrical charges, corotrons for removing electrical charges are provided around the sheet carrier.

However, it was impossible to ascertain whether or not the corotron was perfectly functioning without the actual occurrence of erroneous holding of the record sheet or a failure of transfer of a toner image. In this way, it was impossible for the conventional image forming apparatus to prevent these problems.

SUMMARY OF THE INVENTION

This invention is conceived in view of these problems in the prior art, and has an object of providing an image forming apparatus capable of ensuring the detection of a record sheet held in an absorptive manner by the sheet carrier, even if the area ratio of an image to the record sheet is large and therefore a margin between the leading end of the record sheet and the image is small.

Another object of the present invention is to provide an image forming apparatus capable of preventing erroneous absorption of a record sheet and a failure of transfer of a toner image, as well as acknowledging, at an early stage, whether or not electrical charge has been positively removed from the sheet carrier.

To attain the above objects, the present invention provides an image forming apparatus comprising:

an image carrier on which a toner image is to be formed in accordance with image information;

a sheet carrier for holding a record sheet in a predetermined sheet retaining plane on a surface of the sheet carrier while rotating in synchronism with the image carrier so as to confront the image carrier, and the sheet carrier having a first area that corresponds to a leading portion of the record sheet and is to be partially covered with the record sheet, and a second area that is a part of the surface of the sheet carrier other than the first area, the first area having a lower reflectivity than the second area;

transfer means for transferring the toner image from the image carrier to the record sheet; and a reflection photosensor so disposed as to confront the surface of the sheet carrier, for detecting a reflectivity of the sheet carrier including the first and second areas.

In this image forming apparatus, it is necessary for the low-reflectivity area formed in the sheet carrier to produce a smaller amount of reflected light in response to illumination light from the photosensor than the other area of the sheet carrier. The color of the low-reflectivity area may be changed properly depending on the wavelength of the illumination light from the photosensor. The low-reflectivity area may be formed on the sheet carrier by printing, or by sticking some other member to the sheet carrier.

According to a second aspect of the present invention, the image forming apparatus includes judging means for judging presence or absence of the record sheet in the sheet retaining plane on the basis of a comparison between a detection signal of the reflection photosensor and a predetermined threshold value.

According to a third aspect of the present invention, the reflectivity of the first area is lower than that corresponding to the maximum density of a toner image formed on the record sheet.

According to a fourth aspect of the present invention, the first and second areas have different electrical resistances.

An image forming apparatus according to a fifth aspect of the present invention is similar to the image forming apparatus of the fourth aspect, but it includes:

charge removing means for removing charge from the surface of the sheet carrier including the first and second areas;

potential measuring means disposed downstream of the charge removing means, for measuring a surface potential of the surface of the sheet carrier including the first and second areas; and failure judging means for detecting a failure of the charge removing means on the basis of a comparison between measured surface potentials corresponding to the first and second areas.

An image forming apparatus according to a sixth aspect of the present invention is similar to the image forming apparatus of the fourth aspect, but it includes:

charge removing means for removing charge from the surface of the sheet carrier including the first and second areas;

developing means for directly forming particular toner image on the image carrier;

density measuring means disposed downstream of the charge removing means, for measuring a density of a transferred particular toner image on the surface of the sheet carrier including the first and second areas; and failure judging means for detecting a failure of the charge removing means on the basis of a comparison between measured densities corresponding to the first and second areas.

If there exists a surface potential difference between the low-reflectivity area and the other area of the sheet carrier, the respective areas have different toner image transfer efficiencies, and hence it is possible to ascertain the existence of the surface potential difference based on the densities of transferred toner images.

According to the above mentioned configurations, even if the leading margin of a record sheet retained in the sheet retaining plane in an adsorptive manner is small, a difference in the amount of reflected light between the margin and the low-reflectivity area is large. Therefore, when the leading end of the record sheet passes the photosensor, the detection signal of the photosensor changes significantly.

DESCRIPTION OF THE PREFERRED EMBODIMENTS

With reference to the accompanying drawings, an image forming apparatus according to preferred embodiments of the present invention will be described hereinbelow.

Figure 1:
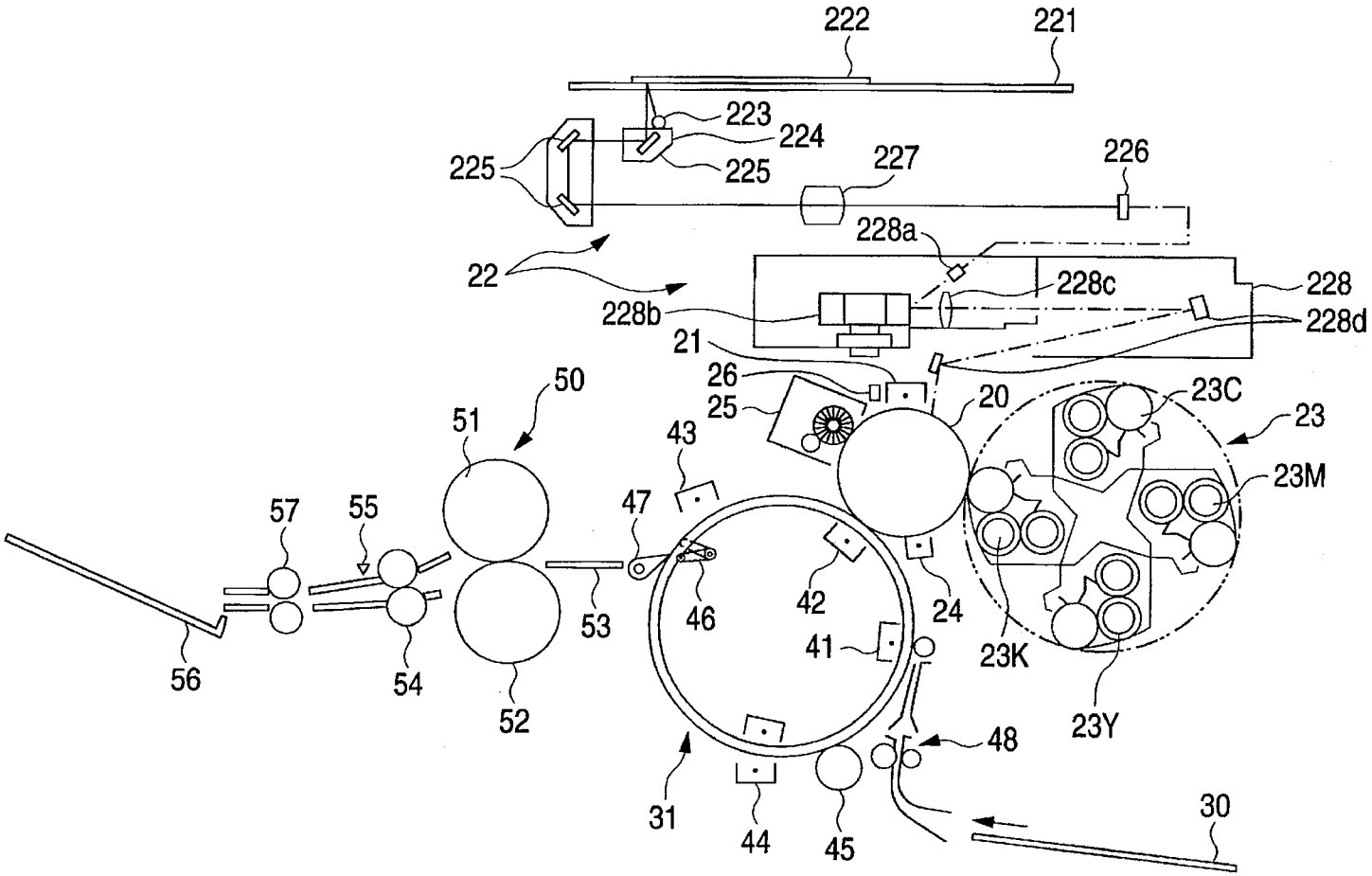
FIG. 1 is a schematic representation showing the construction of a color copier according to a first embodiment of the present invention.

FIG. 1 shows a color copier according to a first embodiment of the present invention. In the drawing, reference numeral 20 is a photoreceptor drum; 21 is a charging corotron for electrostatically charging the surface of the photoreceptor drum 20 in advance of copying operation; 22 is an exposure scanning system for writing a latent image onto the photoreceptor drum 20 electrostatically charged by the charging corotron; 23 is a rotary processing unit which is rotatively disposed so as to be select required color a switchable manner as required and includes four developing instruments 23B, 23C, 23M, and 23Y for respectively housing a black toner image (B), a cyan toner image (C), a magenta toner image (M), and a yellow toner image (Y); 24 is a pre-transfer processing corotron for canceling a potential of the photoreceptor drum 20; 25 is a cleaner for eliminating toner remaining on the photoreceptor drum 20; and 26 is an erase lamp for eliminating electric charge remaining on the photoreceptor drum 20.

In this embodiment, the exposure scanning system 22 is comprised of an exposure lamp 223 for illuminating an original 222 set on a platen 221; a carriage 224 for moving the exposure lamp 222 over the full extent of the original 222; a reflection mirror 225 for guiding a beam from the exposure lamp 222, which has been reflected from the original 222, along a predetermined optical path; a color image sensor 226 for converting the beam reflected from the original 222 into a digital signal for each color component; a focusing lens 227 for focusing the beam reflected from the original 222 onto the color image sensor 226; and a laser scanning unit 228 for exposing the photoreceptor drum 20 to a laser beam in the primary scanning direction on the basis of an image signal for each color component obtained by the image sensor 226. The laser scanning unit 228 is made up of a semiconductor laser 228*a*, a polygon mirror 228*b* for deflecting a beam from the semiconductor laser 228*a* over the photoreceptor drum 220 in the primary scanning direction thereof; a focusing lens 228*c* for focusing the beam from the semiconductor laser 228*a* onto the photoreceptor drum 20 along the line in the primary scanning direction of the photoreceptor drum; and a reflection mirror 228*d* for controlling the beam path.

Figure 2:
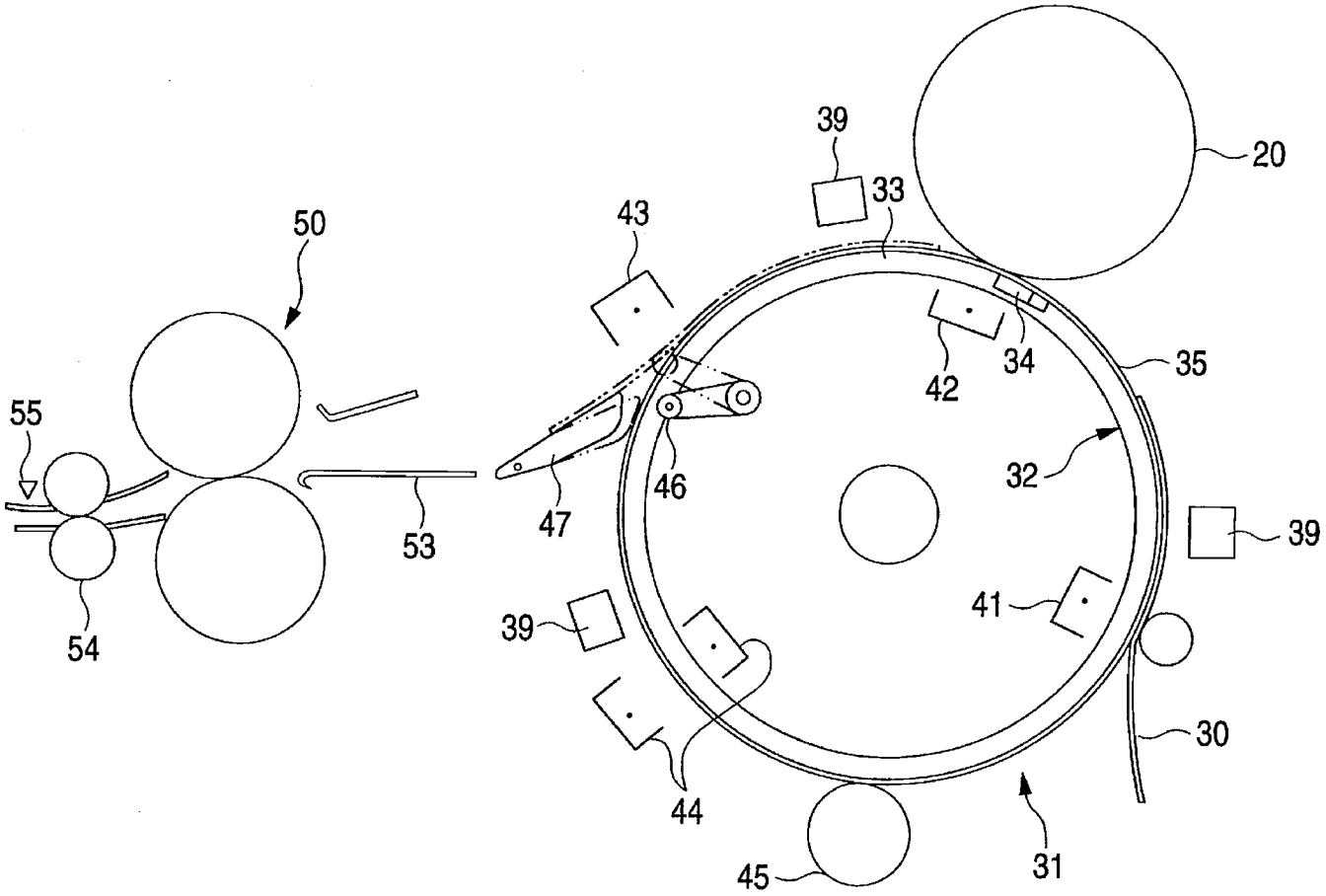
FIG. 2 is a schematic representation showing a transfer drum and its peripheral equipment.
Figure 3:
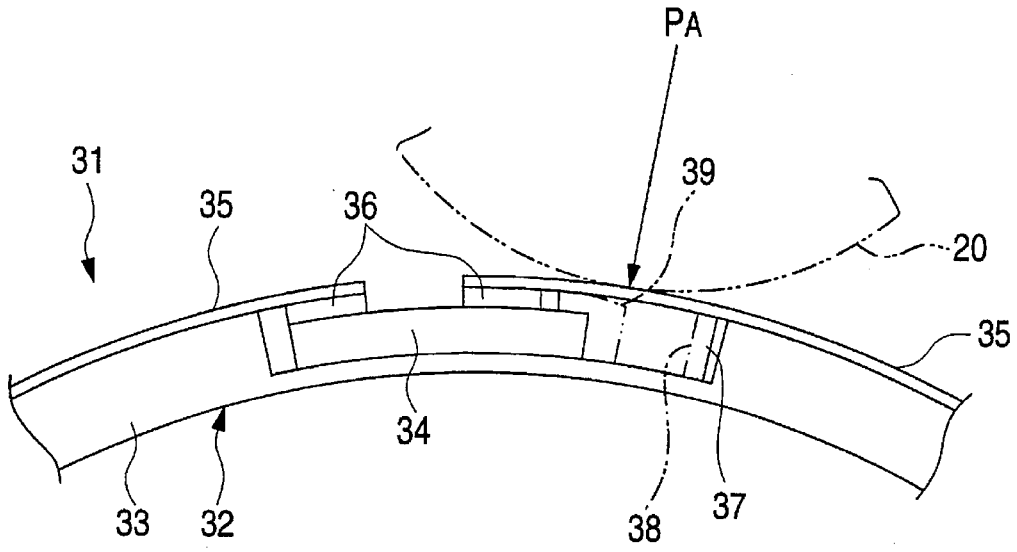
FIG. 3 is an enlarged partial cross section showing the area around a tie bar of the transfer drum.

Reference numeral 31 is a transfer drum. A record sheet 30 is wrapped around the circumferential surface of the transfer dram 31, and color toner images formed on the photoreceptor drum 20 are superimposed in turn on this record sheet 30. As shown in FIGS. 2 and 3, the transfer drum 31 is made up of a drum frame 32, and this drum frame 32 is comprised of a pair of ring members 33 joined together by one tie bar 34. A drum sheet 35 made of, e.g., polyvinylidene fluoride is stretched along the circumferential side of the drum frame 32 by way of fixing members 36. Having previously been electrostatically charged, the drum sheet 35 electrostatically holds the record sheet 30.

Further, an adjuster plate 37 is disposed adjacent to the tie bar 34 on the reverse rotation side for preventing the drum sheet 35 from hanging over. Through-holes 38 are formed in the adjuster plate 37 in a ladder-like arrangement for affording electrical charges to the drum sheet 35.

Furthermore, as shown in FIGS. 1 and 2, the transfer drum 31 is provided with an adsorbing corotron 41 for electrostatically charging the drum sheet 35 when the drum sheet 35 retains the record sheet 30; a transfer corotron 42 for transferring the toner image on the photoreceptor drum 20 to the record sheet 30; an electrical-charge-removing corotron 43 for removing electrical charges from the record sheet 30 after the toner image in the final color has been transferred to the record sheet; a cleaning charge-removing corotron 44 for removing electrical charges from the drum sheet 35 after the toner image in the final color has been transferred to the record sheet; a cleaning brush 45 for cleaning dust such as paper powder adhering to the drum sheet 35 after the toner image in the final color has been transferred to the record sheet; an inner press roller 46 for pressing the drum sheet 35 from the inside when the record sheet 30 is removed from the transfer drum 31; and an exfoliation finger 47 for removing the record sheet 30. Reference numeral 48 is a sheet conveyance system for conveying the record sheet 30 fed from a sheet feeding cassette (not shown) to the absorbing corotron 41 with predetermined timing corresponding to each mode.

Additionally, sheet detection sensors 39 are disposed at several points around the transfer drum 31 for detecting the record sheet 30 retained by the transfer drum 31 in an adsorptive manner. Each of these sheet detection sensors 39 is a reflection photosensor which is made up of a light emitting portion for principally emitting an infrared ray and a light receiving portion for detecting the infrared ray reflected from the transfer drum 31. The three sheet detection sensors 39 are disposed in respective downstream directions of the adsorbing corotron 41, the transfer corotron 42, and the exfoliation finger 47. These sheet detection sensors 39 are driven in a time-shared manner in synchronism with a rotation reference signal of the transfer drum 31. Each sheet detection sensor 39 detects the leading end of the record sheet 30 retained by the transfer drum 31 when the leading end passes the imaginary line between the light emitting portion and the light receiving portion of the sheet detection sensor 39.

Reference numeral 50 is a fusing unit for fusing an unfixed toner image onto the record sheet 30 while the record sheet 30 undergoing the transfer process is passing through this fusing unit. In this embodiment, the fusing unit 50 is made up of a heating roller 51 with a built-in heater and a press roller 52 brought into pressed contact with the heating roller 51. The record sheet 30 fed from the transfer drum 31 is conveyed to the fusing unit 50 via a guide plate 53. Reference numeral 54 is a fuser exit roller for carrying the record sheet 30 having passed through the fusing unit 50, 55 is a fuser exit switch for detecting the tail end of the record sheet 30 when the record sheet 30 has passed through the fusing unit 50, 56 is a discharge tray for holding fused record sheets 30, and 57 is an exit roller for sending the record sheet 30 to the discharge tray 56.

In the color copier having the above construction, when the user turns on a start switch of the copier, the original 222 is scanned, and a latent image corresponding to black (K) is written onto the photoreceptor drum 20. On the other hand, the black processing instrument 23K of the rotary processing unit 23 is set so as to be opposite to the photoreceptor drum 20, and the processing of the latent image by the black processing instrument 23K slightly lags behind the timing of the writing of the latent image. The thus formed black toner image K is transferred to the record sheet 30 retained by the transfer drum 31. When the processing of the latent image by the black processing instrument 23K has been completed, the processing instrument is replaced with another instrument before one cycle of rotation of the transfer drum 31 is completed. The yellow developing instrument 23Y is then set so as to be opposite to the photoreceptor drum 20 as a result of the rotation of the rotary processing unit 23 through 90 degrees.

These operations are then repeated for every one cycle of rotation of the transfer drum 31. Every time the processing instrument is replaced with another one, the toner images in yellow Y, magenta M, and cyan C are transferred in turn from the photoreceptor drum 20 onto the record sheet 30 retained by the transfer drum 31. As a result, a color toner image is formed on the record sheet 30 as a result of overlaying the four color toner images on top of each other. After the transfer of the toner image in cyan C onto the record sheet 30 has been completed, the record sheet 30 is removed from the transfer drum 31, and the thus removed record sheet 30 is discharged onto the discharge tray 56 via the fusing unit 50.

In this way, the color copier of this embodiment, in which an image is formed in the manner as previously mentioned, is arranged in such a way as to select a suitable absorbing position for the record sheet on the transfer drum 31 depending on the size and type of the record sheet 30.

Figure 4:
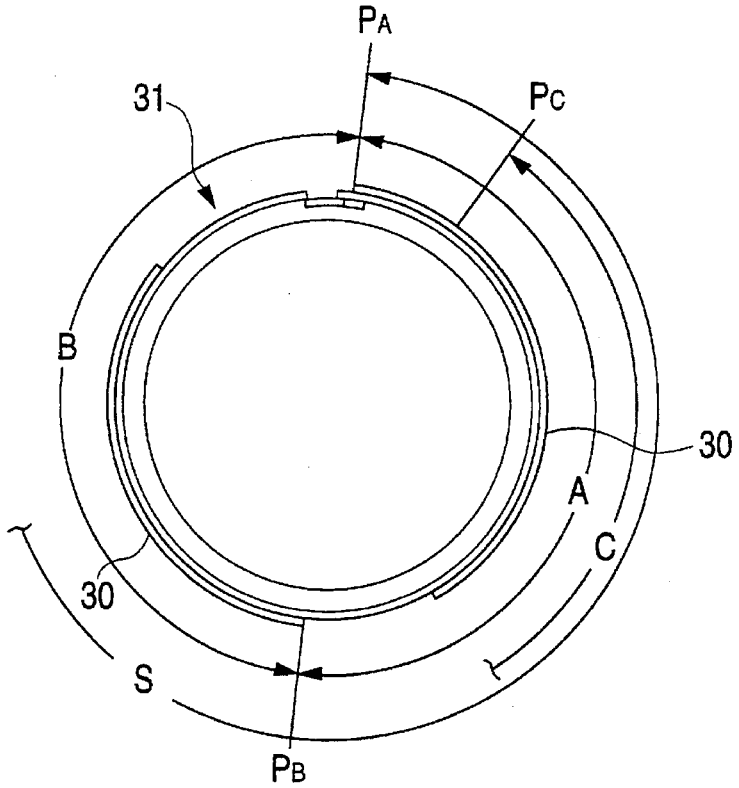
FIG. 4 is a schematic representation showing sheet retaining planes of the transfer drum.

As shown in FIG. 4, the circumferential surface of the transfer drum 31 is provided with sheet retaining planes A and B. If the record sheet 30 is smaller in size than the JIS A4 size or standard letter size, two record sheets 30, 30 will be retained in-the respective retaining planes A and B at one time. A leading end reference $P_A$ is positioned on the adjuster plate 37 which is slightly dislocated in the downward direction of the rotation of the transfer drum 31 in relation to the tie bar 34. A leading end reference $P_B$ of the retaining plane B is spaced apart from the leading end reference $P_A$ by 180 degrees. Record sheets in sizes other than the above mentioned sizes are retained in the sheet retaining plane A or an area S which extends from the sheet retaining plane A to a part of the sheet retaining plane B.

The leading end reference $P_A$ of the sheet retaining plane A overlaps the adjuster plate 37, and it is difficult for the adsorbing corotron 41 to afford sufficient electrical charges to the rear surface of the drum sheet 35. If a record sheet 30 which is more difficult to bend, such as an OHP film or cardboard, is retained in the sheet retaining plane A, there is a likelihood that the leading end of the record sheet 30 will become peeled away from the drum sheet 35. For this reason, in this embodiment, a sheet retaining plane C is set at a position which is slightly spaced apart from the sheet retaining plane A in the rearward direction. The record sheet 30 that is more difficult to bend, as an OHP film or cardboard, is retained in this sheet retaining plane C. Accordingly, the leading end reference $P_C$ of this sheet retaining plane C does not overlap the adjuster plate 37.

If the record sheet 30 is retained in the sheet retaining plane A for the same reasons, it is difficult for the transfer corotron 42 to provide the leading end of the record sheet 30 with sufficient electrical charges. Therefore, in the event that the original with a smaller margin at the leading end of the record sheet is retained in the sheet retaining plane A, there is a likelihood that a blank image will be formed at the leading end of the record sheet 30. To prevent this problem, the color copier of this embodiment is provided with a brim erase level reducing mode which permits the user to optionally select the sheet retaining plane C. In the case of the original such as a photograph or a picture which is desired to be copied with a smaller margin at the leading end of the record sheet, the record sheet 30 is retained in the sheet retaining plane C.

Figure 8:
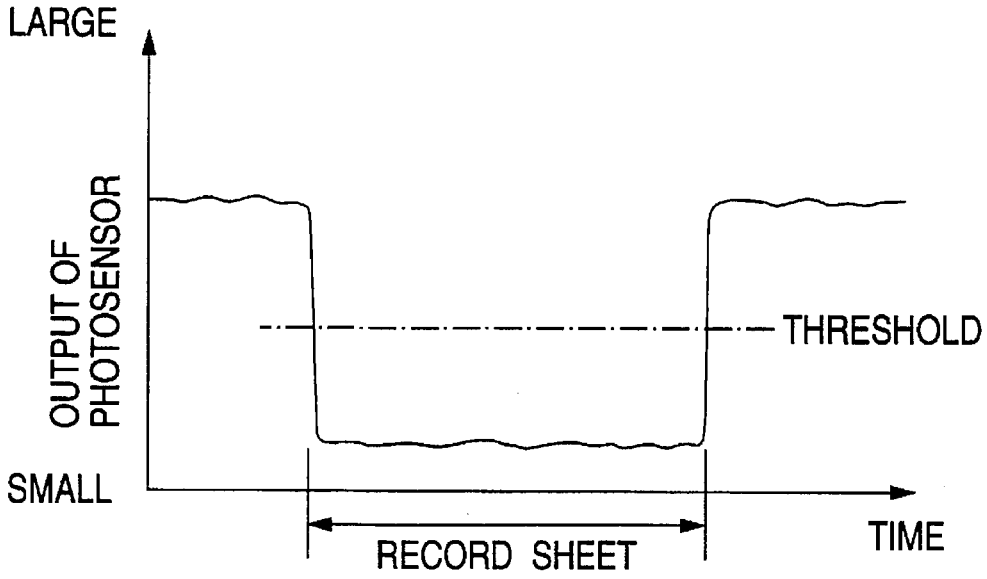
FIG. 8 is a schematic representation showing an output from the sheet detection sensor when a white plain record sheet is detected.

In the case of the record sheet 30 retained in either the sheet retaining plane A or B, when the record sheet 30 has passed the sheet detection sensors 39, the output signal of each of the seat detection sensors 39 varies such as shown in FIG. 8. Therefore, it is possible to ensure a large signal-to-noise ratio for the output signal of the sheet detection sensor. For this reason, even if the sheet carrier becomes dirty or the color of the record sheet for recording an image changes as a result of a lapse of time, an accurate and reliable judgement as to whether or not the leading end of the record sheet 30 has passed the sheet detection sensor can be ensured over a long period of time by setting an appropriate threshold value and checking whether or not the output of the sheet detection sensor 39 has crossed the threshold value.

Figure 9:
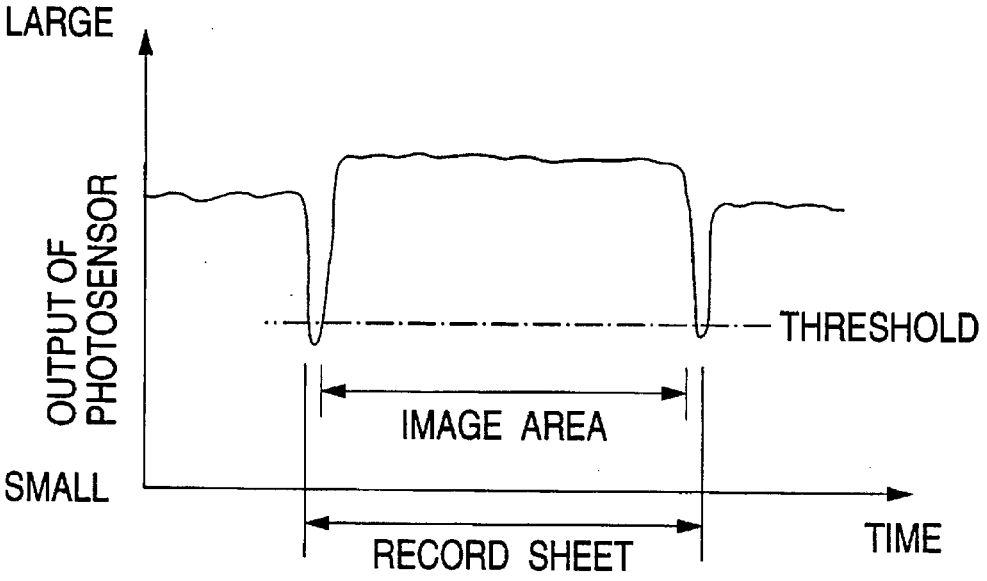
FIG. 9 is a plot showing an output from the sheet detection sensor when a margin provided at the leading end of a record sheet is small.

However, in the case of the record sheet 30 relevant to the brim erase level reducing mode among the record sheets 30 to be retained in the sheet retaining plane C, i.e., the record sheet 30 having a small margin at the leading end thereof after the toner image has been transferred thereto, an output signal of each of the sheet detection sensors 39 varies at a smaller signal-to-noise ratio such as it is shown in FIG. 9. This small signal-to-noise ratio makes it difficult to detect the passage of the record sheet.

Figure 5:
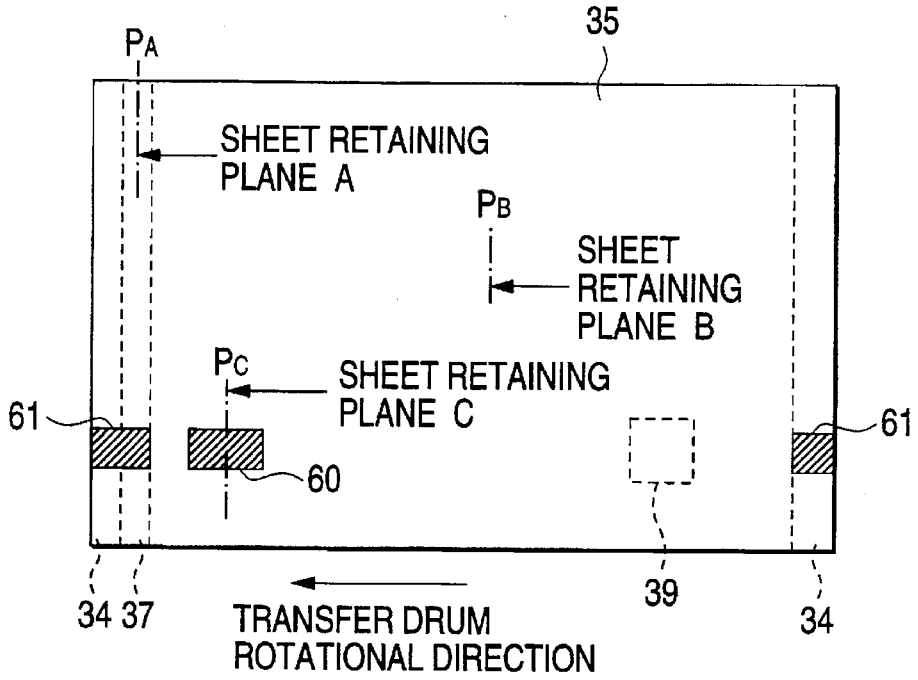
FIG. 5 is an exploded view of a drum sheet of the transfer drum.

In this embodiment, as shown in an exploded view of a drum sheet 35 shown in FIG. 5, a low-reflectivity area 60 is printed at the position in the sheet retaining plane C which is opposite to the sheet detection sensor 39 and corresponds to the leading end reference $P_C$. As a result, when the record sheet 30 is retained in the sheet retaining plane C, a part of the low-reflectivity area 60 is covered with the record sheet 30. This low-reflectivity area 60 is formed in black so as to easily adsorb infrared rays emitted from the sheet detection sensor 39. The low-reflectivity area 60 should preferably have a reflectivity which is lower than a saturated level of the concentration of the toner processed on the record paper.

Figure 6:
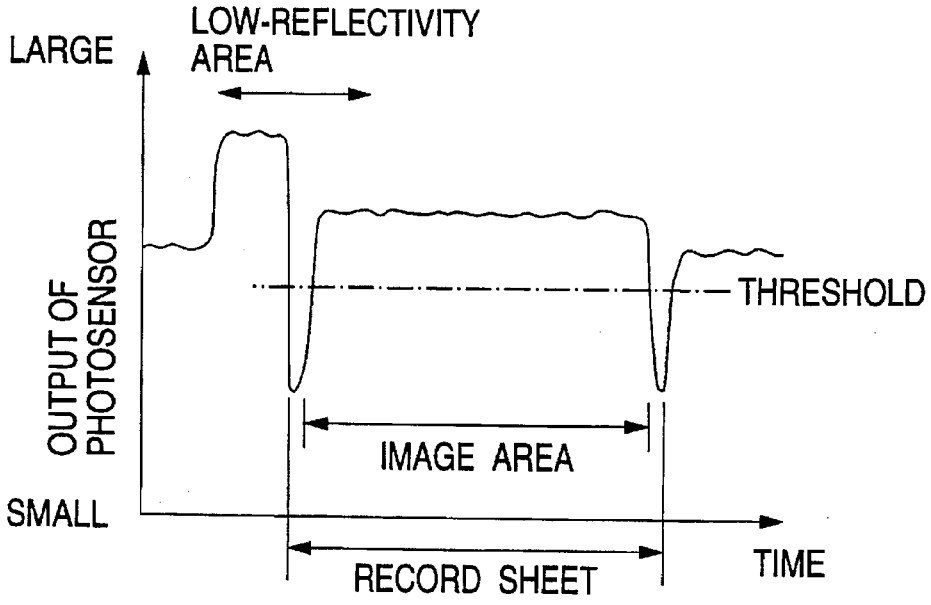
FIG. 6 is a plot showing an output from a sheet detection sensor which corresponds to a sheet retaining plane C.

When the record sheet 30 relevant to the brim erase level reducing mode is retained in the sheet retaining plane C, the output of the detection signal from the sheet detection sensor 39 changes, for example, as shown in FIG. 6. In other words, the detection signal output corresponding to the low-reflectivity area 60 becomes larger than the detection signal output corresponding to the drum sheet 35 itself. Accordingly, it is possible to ensure a large signal-to-noise ratio between the detection signal output corresponding to the low-reflectivity area 60 and the detection signal output corresponding to the margin at the leading end of the record sheet 30. As a result, it becomes possible to reliably detect the leading end of the record sheet 30 by use of an appropriate threshold value. By virtue of the low-reflectivity area 60 formed on the drum sheet 35, the sheet detection sensor 39 can detect the leading end of the record sheet 30 even when the image margin at the leading end of the record sheet 30 is reduced to 4 mm.

The low-reflectivity area 60 yields the same effect when the copy job is carried out while the OHP film is retained in the sheet retaining plane C. When the OHP film is retained in the sheet retaining plane C, the film makes it possible to see through the drum sheet 35 itself. Even when a white painted portion similar to the margin along an image on the ordinary paper is formed at the leading end of the OHP film, the signal-to-noise ratio of the output of the sheet detection sensor 39 should become smaller. However, if a part of the low-reflectivity area 60 formed on the drum sheet 35 is covered with the leading end of the OHP film in the same manner as previously mentioned, it is possible to ensure a large signal-to-noise ratio of the detection signal between the white painted portion and the low-reflectivity area 60. Hence, it is possible to reliably detect the leading end of the OHP film.

FIG. 5 shows other black low-reflectivity areas 61 painted at both ends of the drum sheet 35. These low-reflectivity areas 61 are intended to prevent the tie bar 34 and the adjuster plate 37 from being offset onto the surface of the drum sheet 35. The low-reflectivity areas 61 are provided to prevent the sheet detection sensors 39 from erroneously judging that the tie bar 34 and the adjuster plate 27 are the record sheet 30.

An image forming apparatus according to a second embodiment of the present invention will now be described.

In this second embodiment, it is judged as to whether or not the cleaning charge-removing corotron 44 disposed around the transfer drum 31 is perfectly functioning by utilization of the low-reflectivity area 60 (hereinafter occasionally referred to as a second area) formed on the drum sheet 35 in the first embodiment.

Specifically, when the low-reflectivity area 60 is printed to, or adhered onto, the drum sheet 35, the low-reflectivity area 60 is different in electrical resistance from the other areas of the drum sheet 35 (hereinafter referred to as a peripheral area). More preferably, another second area having a higher electrical resistance should be formed. If the cleaning charge-removing corotron 44 is functioning perfectly, a surface potential of the drum sheet 35 whose electrical charges were removed by the cleaning charge-removing corotron 44 should be even, and no potential difference should arise between the low-reflectivity area 60 and the peripheral area. However, if the cleaning charge-removing corotron 44 is not functioning perfectly, a potential difference more than a predetermined level should remain between the low-reflectivity area 60 and the peripheral area which have different electrical resistances.

Figure 7:
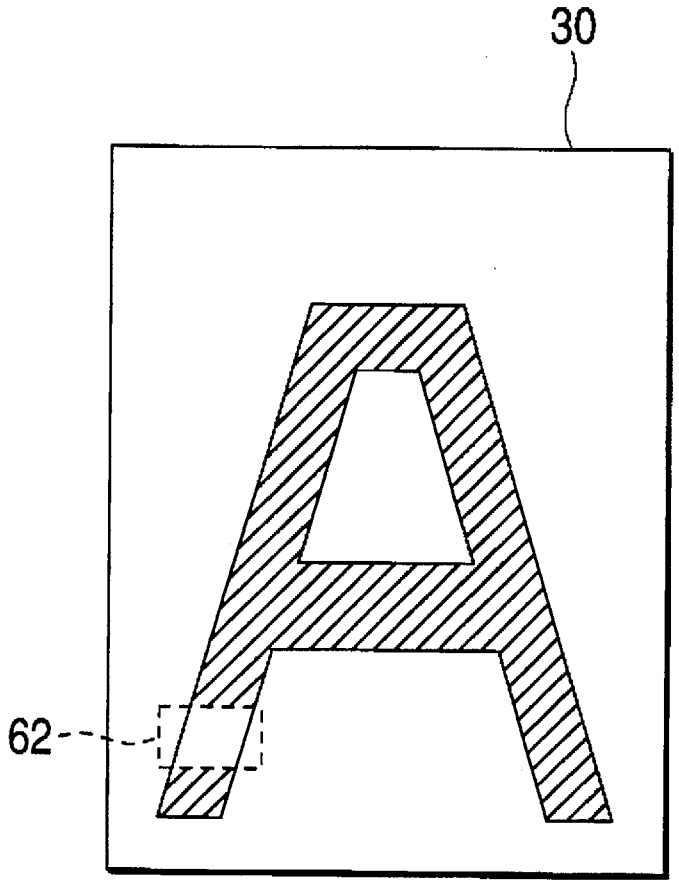
FIG. 7 is a schematic representation showing a white blank formed in a copied image which corresponds to a low-reflectivity area.
Figure 10:
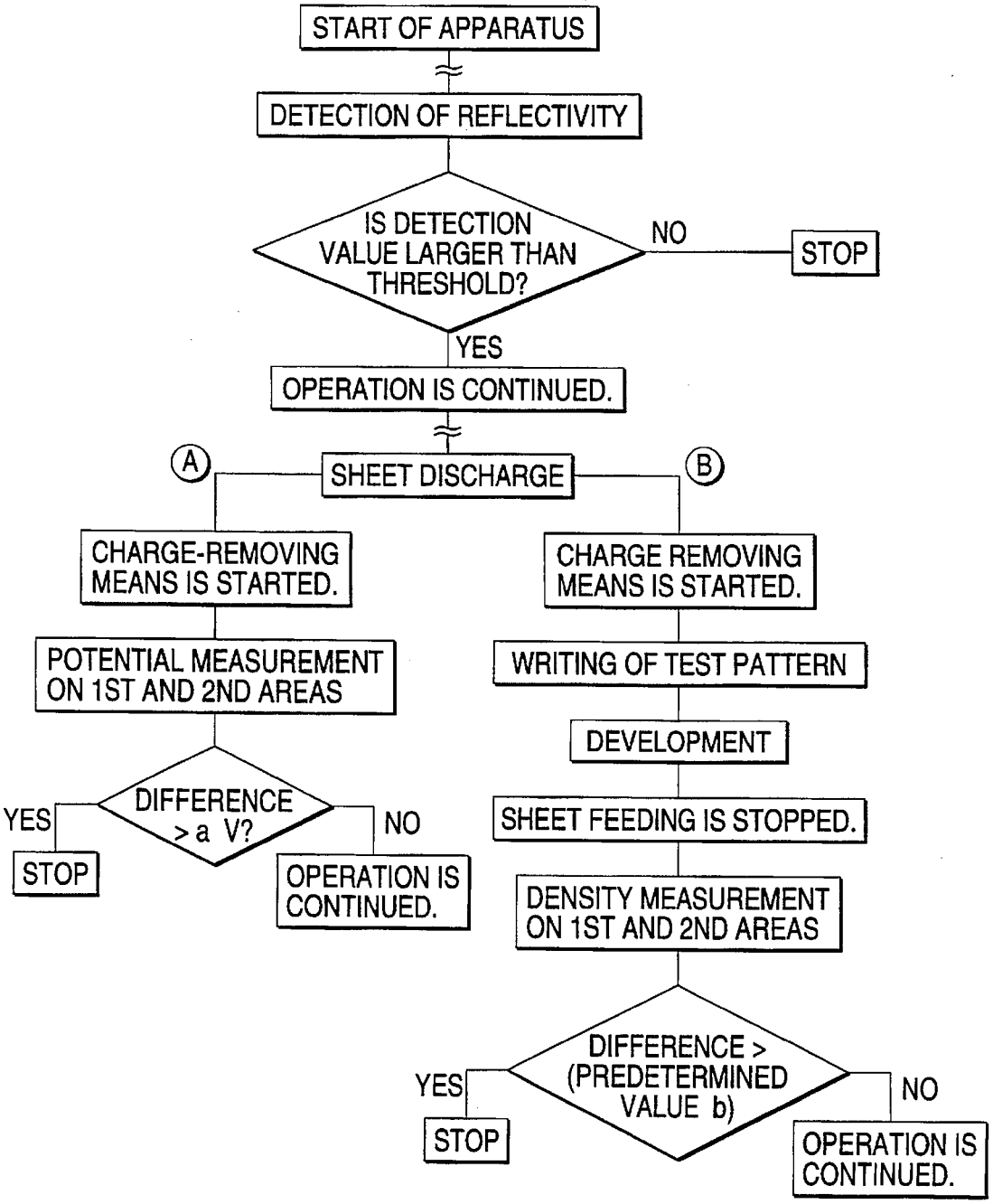
FIG. 10 is a flow chart showing processes for checking whether or not the record sheet is present in the sheet holding plane on the sheet carrier on the basis of the output of the sheet detection sensor.

Therefore, a potentiometer is disposed around the transfer drum 31 so as to be opposite to the low-reflectivity area, and it becomes possible to verify whether or not the cleaning charge-removing corotron 44 is perfectly functioning by judging whether or not there is a difference between predetermined areas from a result of the measurement of a potential difference between the low-reflectivity area 60 and the peripheral area. In this respect, as indicated by reference symbol A shown in FIG. 10, if a potential difference of more than a predetermined a V remains between the low-reflectivity area 60 and the peripheral area, a field intensity which causes the transfer of a toner image becomes different depending on either the low-reflectivity area 60 or the peripheral area, even when the rear surface of the drum sheet 35 is evenly electrostatically charged by the transfer corotron 42. For this reason, if the cleaning charge-removing corotron 44 is perfectly functioning, the efficiency of transfer of a toner image is different depending on either the low-reflectivity area 60 or the peripheral area. If the electrical resistance of the low-reflectivity area 60 is set larger than that of the peripheral area, a white blank 62 corresponding to the low-reflectivity area 60 shown in FIG. 7 is generated in the toner image transferred onto the record sheet 30. Further, even if the white blank is not generated, the density of the area of the image corresponding to the low-reflectivity area 60 becomes lower than that of the peripheral area.

In the color copier of this embodiment, the record sheet 30 retained in the sheet retaining plane A of the transfer drum 31 completely covers the low-reflectivity area 60 formed at the leading end of the sheet retaining lane C. As a result, it is possible to check whether or not the cleaning charge-removing corotron 44 is perfectly functioning by checking whether or not an uneven transferred toner image or a white blank is generated at the position in a copied record image corresponding to the low-reflectivity area 60 when the copy job is carried out using the sheet retaining plane A.

Further, in the case of a copier provided with a system which measures the density of toner images (hereinafter referred to as reference patches) in a specific pattern experimentally formed on the photoreceptor drum 20 and controls the density of an image based on a result of the measurement, it is also possible to check whether or not the removal of electrical charges from the drum sheet 35 is sufficient by utilization of this system. In other words, as indicated by reference symbol B shown in FIG. 10, the reference patches are continuously formed on the photoreceptor drum 20, and these patches are transferred onto the low-reflectivity area 60 and its surrounding area. A difference in density between the patches transferred onto the low-reflectivity area 60 and the patches transferred onto the surrounding area is measured by the photosensor disposed around the transfer drum 31, and it is judged, based on the result of the measurement, as to whether or not there is a difference in density between these predetermined areas. Such an arrangement enables a check, based on the detection signal from the photosensor, as to whether or not the cleaning charge-removing corotron 44 is perfectly functioning. If it is judged that the removal of the electrical charges from the drum sheet 35 is incomplete, that state of the drum sheet is displayed on an operation panel of the copier so as to prohibit the user from carrying out the subsequent copy jobs.

As described above, according to the color image forming apparatus and method of this invention, a low-reflectivity area which is partially covered with a record sheet is formed at the leading end of a sheet retaining plane provided on a sheet carrier, and a detection signal of a photosensor significantly changes when the leading end of the record sheet retained in the sheet carrier passes through the photosensor. As a result, reliable and accurate detection of the record sheet retained by the sheet carrier in an adsorptive manner can be ensured over a long period of time even if an area ratio of an image to a record sheet is large and therefore only a small image margin is provided at the leading end of the record sheet.

Further, as a result of a difference in electrical resistance between the low-reflectivity area and the other area in the sheet carrier, the difference develops as a difference in surface potential between these areas if the removal of the electrical charges of the sheet carrier is incomplete. Hence, it is possible to ascertain whether the removal of the electrical charges of the sheet carrier is reliably carried out at an early stage, and it becomes possible to previously prevent the erroneous absorption of a record sheet and a failure of transfer of the toner image. By virtue of the provision of the single low-reflectivity area, it becomes possible to check whether or not a record sheet is present, and whether or not the cleaning corotron is functioning perfectly.

What is claimed is:

1. An image forming apparatus comprising:

an image carrier on which a toner image is to be formed in accordance with image information;

a sheet carrier for holding a record sheet in a predetermined sheet retaining plane on a surface of the sheet carrier while rotating in synchronism with the image carrier so as to confront the image carrier, and the sheet carrier having a first area that corresponds to a leading portion of the record sheet and is to be partially covered with the record sheet, and a second area that is a part of the surface of the sheet carrier other than the first area, the first area having a lower reflectivity than the second area;

transfer means for transferring the toner image from the image carrier to the record sheet;

a reflection photosensor so disposed as to confront the surface of the sheet carrier, for detecting a reflectivity of the sheet carrier including the first and second areas; and means for judging the presence or absence of the record sheet in the sheet retaining plane on the basis of a comparison between a detection signal of the reflection photosensor and a predetermined threshold value.

2. The image forming apparatus as defined in claim 1, wherein a reflectivity of the first area is lower than that corresponding to a maximum density of a toner image formed on the record sheet.

3. The image forming apparatus as defined in claim 1, wherein the first and second areas have different electrical resistances.

4. The image forming apparatus as defined in claim 3, further comprising:

charge removing means for removing charge from the surface of the sheet carrier including the first and second areas;

potential measuring means disposed downstream of the charge removing means, for measuring a surface potential of the surface of the sheet carrier including the first and second areas; and failure judging means for detecting a failure of the charge removing means on the basis of a comparison between measured surface potentials corresponding to the first and second areas.

5. The image forming apparatus as defined in claim 3, further comprising:

charge removing means for removing charge from the surface of the sheet carrier including the first and second areas;

developing means for directly forming particular toner image on the image carrier;

density measuring means disposed downstream of the charge removing means, for measuring a density of a transferred particular toner image on the surface of the sheet carrier including the first and second areas; and failure judging means for detecting a failure of the charge removing means on the basis of a comparison between measured densities corresponding to the first and second areas.

6. An image forming method comprising the steps of:

forming a toner image on an image carrier in accordance with image;

retaining a record sheet on a sheet carrier while rotating it in synchronism with the image carrier, the sheet carrier having a first area that is located at a leading portion of a predetermined sheet retaining plane and is to be partially covered with the record sheet, and a second area that is a part of the surface of the sheet carrier other than the first area and has a higher reflectivity than the first area;

transferring the toner image from the image carrier onto the record sheet;

detecting a reflectivity of the sheet carrier including the first and second areas; and judging presence or absence of the record sheet in the sheet retaining plane on the basis of a comparison between a detection signal obtained in the reflectivity detecting step and a predetermined threshold value.

7. An image forming apparatus comprising:

an image carrier on which a toner image is to be formed in accordance with image information;

a sheet carrier for holding a record sheet in a predetermined sheet retaining plane on a surface of the sheet carrier while rotating in synchronism with the image carrier so as to confront the image carrier, and the sheet carrier having a first area that corresponds to a leading portion of the record sheet and is to be partially covered with the record sheet, and a second area that is a part of the surface of the sheet carrier other than the first area, the first area having a lower reflectivity than the second area;

means for transferring the toner image from the image carrier to the record sheet; and a reflection photosensor so disposed as to confront the surface of the sheet carrier, for detecting a reflectivity of the sheet carrier including the first and second areas; and wherein a reflectivity of the first area is lower than that corresponding to a maximum density of a toner image formed on the record sheet.

8. An image forming apparatus comprising:

an image carrier on which a toner image is to be formed in accordance with image information;

a sheet carrier for holding a record sheet in a predetermined sheet retaining plane on a surface of the sheet carrier while rotating in synchronism with the image carrier so as to confront the image carrier, and the sheet carrier having a first area that corresponds to a leading portion of the record sheet and is to be partially covered with the record sheet, and a second area that is a part of the surface of the sheet carrier other than the first area, the first area having a lower reflectivity than the second area;

means for transferring the toner image from the image carrier to the record sheet; and a reflection photosensor so disposed as to confront the surface of the sheet carrier, for detecting a reflectivity of the sheet carrier including the first and second areas; and wherein the first and second areas have different electrical resistances.

9. The imaging forming apparatus as defined in claim 8 further comprising:

means for removing charge from the surface of the sheet carrier including the first and second areas;

means disposed downstream of the means for removing charge for measuring a surface potential of the surface of the sheet carrier including the first and second areas; and means for detecting a failure of the means for removing charge on the basis of a comparison between measured surface potentials corresponding to the first and second areas.

10. The image forming apparatus as defined in claim 8, further comprising:

means for removing charge from the surface of the sheet carrier including the first and second areas;

means for directly forming particular toner image on the image carrier;

means disposed downstream of the means for removing charge for measuring a density of a transferred particular toner image on the surface of the sheet carrier including the first and second areas; and means for detecting a failure of the means for removing charge on the basis of a comparison between measured densities corresponding to the first and second areas.

* * * * *